United States Patent [19]

Zabielski

[11] 4,373,825

[45] Feb. 15, 1983

[54] LOOSELEAF PAGE LIFTER

[76] Inventor: Ray F. Zabielski, P.O. Box 92, Roaring Springs, Tex. 79256

[21] Appl. No.: 195,758

[22] Filed: Oct. 10, 1980

[51] Int. Cl.[3] ..... B42F 13/00

[52] U.S. Cl. ..... 402/80 L

[58] Field of Search ..... 402/24, 73, 80 R, 80 L

[56] References Cited

U.S. PATENT DOCUMENTS

| | | | |
|---|---|---|---|
| 791,296 | 5/1905 | Shepherd | 402/80 L X |
| 2,090,231 | 8/1937 | Raynolds | 402/80 L X |
| 2,179,986 | 11/1939 | Trussell | 402/80 L |
| 3,191,604 | 6/1965 | Wance | 402/80 L X |
| 3,591,300 | 7/1971 | Beyer | 402/80 L |
| 3,758,219 | 9/1973 | Stasio et al. | 402/80 L |
| 4,185,934 | 1/1980 | Hodson | 402/80 L |

FOREIGN PATENT DOCUMENTS

| | | | |
|---|---|---|---|
| 75010 | 9/1893 | Fed. Rep. of Germany | 402/80 L |
| 82640 | 2/1964 | France | 402/80 L |
| 1405306 | 3/1965 | France | 402/80 L |

*Primary Examiner*—Joseph H. McGlynn
*Assistant Examiner*—Fred A. Silverberg
*Attorney, Agent, or Firm*—Keil & Witherspoon

[57] ABSTRACT

A page lifting device for use with looseleaf binders containing binding rings. The leaves of the page lifter are formed from one or more, rigid or flexible sheets of material or loops of stiff wire affixed at their inner edges to the inside of the binder at the base of the binding rings by hinged or flexible means. They can contain slots therein, which allow them to fit over the binder rings on closing, or be one or more rigid or flexible sheets located between the binder rings, and affixed to the inside of the binder such that the leaf or leaves envelope and lift the looseleaf pages away from the binder spine on closing.

4 Claims, 5 Drawing Figures

FIG. 1
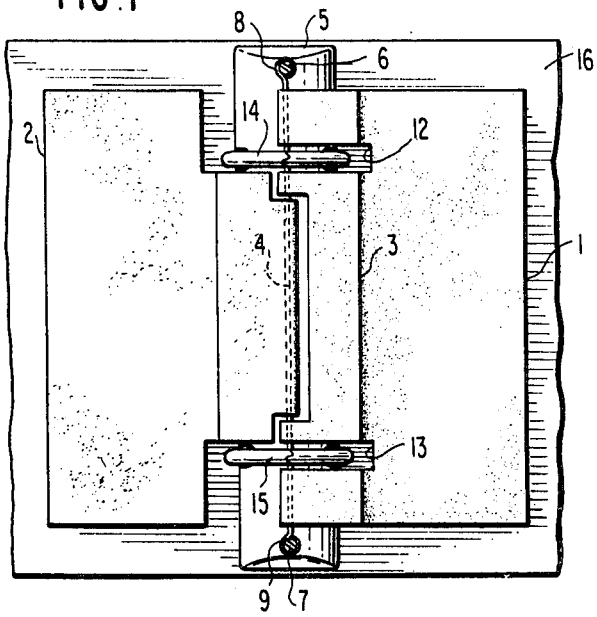
FIG. 2
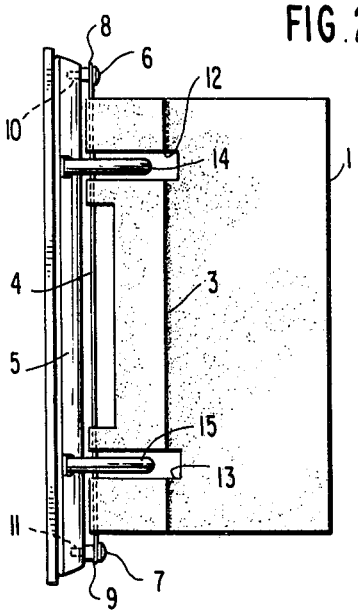
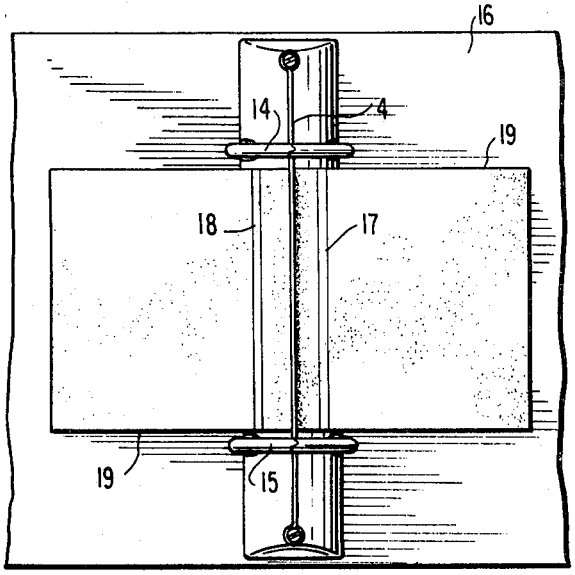
FIG. 3
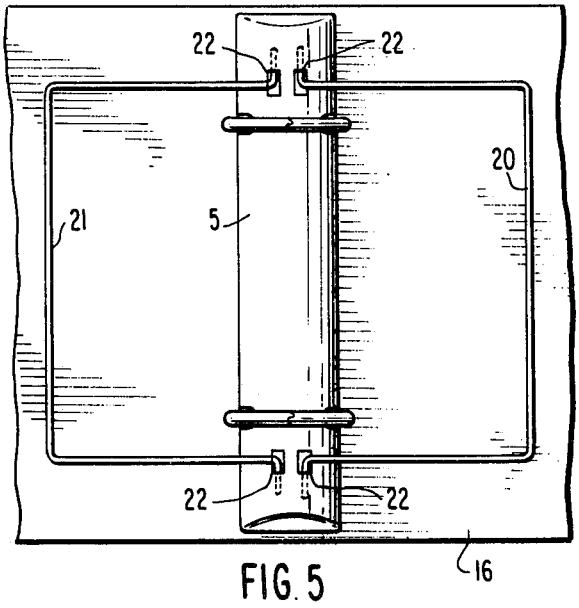
FIG. 5
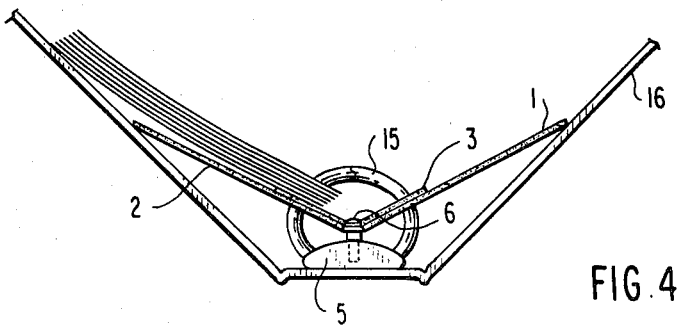
FIG. 4

LOOSELEAF PAGE LIFTER

This invention relates to page lifting devices which are used to facilitate the closing of looseleaf binders. Pages at the front and back of looseleaf binders, unless lifted, remain at the base of the rings near the spine of the binder on closing. Unless these pages are manually moved to the top half of the rings, or a functional page lifting device is used, the pages toward the front and back of the binder become torn at their holes and must be repaired and reinforced. This problem can become of a particular nuisance with frequently used catalogues and manuals.

A variety of devices are in common use which are intended to lift or protect looseleaf pages. Many of the available devices require some manual lifting of the pages on closing the binder or are of complicated construction and therefore are somewhat costly, or both.

The number of such devices in common use and the failure of many to be wholly effective without manual assistance underscores the need for a page lifting device which is both 100% effective and simple, as presently described. In addition, some embodiments of the present invention will be particularly suited to use with binders having more than the typical three rings, for which expensive custom-manufactured page lifters are now required.

One common problem with presently used page lifters is that there is no means by which sufficient leverage is gained to force the pages in a filled binder to the top half of the ring on closing the binder. It is the solution to this problem by means of affixing the page lifter to the cover of the ring base that, in its simplicity and effectiveness, although previously unthought of, particularly distinguishes the present invention.

One object of the present invention is to provide a 100% effective page lifter which will itself not be caught at the base of the binder ring by the press of the looseleaf pages. This is accomplished either by locating the leaves of the page lifter between the binder rings, or by cutting slots at the inner edges of each leaf of sufficient size to pass over the rings without touching on closing, or by using a loop of stiff wire to form the binder leaf.

Another object of the present invention is to provide a page lifter which, on closing the binder, has sufficient force to lift the pages of a filled binder. This is accomplished by affixing the page lifter to the cover of the ring base; that is, essentially, to the center of the inside of the binder. By attaching the page lifter in this way, sufficient leverage is provided on closing the binder to force the pages to the top half of the rings where they will not jam or be damaged by contact with the binder cover.

A further object of the present invention is to offer a page lifting device which, while wholly effective, is simply and inexpensively made. The leaves of the page lifter in the present invention can be made from sheets of any rigid or flexible smooth material cut or molded using conventional methods depending on the materials and the embodiments chosen. They can also be made from loops of stiff wire.

For example, in the embodiment in which a plurality of leaves are located between the rings of the binder and attached in their centers to the ring base cover, the leaves of the page lifter can be made from plastic sheet, or even stiff paper board, which can be cut to fit by the user.

It is intended that page lifters as herein described will be installed as part of the binder manufacturing process.

It is also intended that the invention as herein described will be made available to be fitted to existing binders by the user. Conventional means for attaching the page lifter to the inside of the binder will be provided and may include screws, pins or adhesives.

For example, a kit including leaves of light plastic or paper board sheet could be provided such that the leaves can be cut to fit any looseleaf binder using ordinary scissors. This kit would also include a stiff wire and self-tapping screws such that the user would drill small holes at each end of the ring base cover; insert a screw in each hole; pass the wire through a tubular channel pre-formed in, or attached to the inner edge of each leaf, in which slotted holes have already been cut by the user to pass over the rings on closing the binder; bend the ends of the wire around the screws forming a loop; and tighten the screws to anchor the page lifter to the ring base cover, and thus install the page lifters.

For a second example of retrofit, a kit could be provided, as described in the example above, but with the leaves as two flat sheets joined at their inner edges using plastic or fabric tape forming a flexible joint. The joined leaves could then be cut horizontally into strips, across the flexible joint, to creat a multiplicity of flexibly joined leaves of a proper width to fit between the rings of the subject binder. These leaves could then be attached to the binder using a stiff wire rod, as above, passing the leaves under the wire until the flexible joint lies under the wire and tightening the screws to hold the leaves in place by friction.

Other conventional mechanical means of attaching the leaves to the binder ring base cover include: welds or rivets with rods; welds, rivets, screws or pins alone; and conventional hinge devices. The leaves can also be attached by flexible means such as an adhesive with cloth, plastic or other flexible materials.

In addition, the page lifting device leaves could themselves be of highly flexible material, used as in the second example above, but without the flexible joint, it being unnecessary because of the flexibility of the leaf material itself.

In another embodiment, the leaves could be made from loops of stiff wire. Such a loop would be affixed around or between each of one or more of the binder rings, or affixed such that one loop encloses more than one ring.

FIG. 1 is a top view of the preferred embodiment of the page lifter lying open in an looseleaf binder.

FIG. 2 shows the single right leaf of the page lifter viewed from the left side with the leaf being perpendicular to the spine of the loose leaf binder.

FIG. 3 is a top view of another embodiment of the page lifter comprising a single sheet of highly flexible material.

FIG. 4 is an end view of the binder of FIG. 1, wherein the binder is partially closed.

FIG. 5 is a top view of another embodiment of the page lifter comprising stiff wire loops located outside of the rings of a two ring binder.

In the embodiment shown in FIG. 1 and FIG. 2, the inner edge 3 of the leaf is folded around the rod 4, by which the leaves are attached to the ring closing mechanism cover 5, forming an integral hinge.

The means of anchoring the rod 4 to the ring base cover 5 in this embodiment is by screws 6 and 7 which pass through loops 8 and 9 in the ends of the thin rod 4 into holes 10 and 11 in the ring base cover 5. For ordinary purposes, a stiff wire looped at each end for the rod 4 and self-tapping screws for 6 and 7 should be more than adequate. Page lifter kits can be offered for retrofit which only require the user to drill the two small holes 10 and 11 in the ring base cover 5 and form the loops 8 and 9 by bending.

In FIGS. 1 and 2 the embodiment shown of the page lifter leaf is with slots 12 and 13 cut out of the leaf providing openings which enable the page lifter leaves to move across the binder rings 14 and 15 without touching. This type of page lifter will be of greatest use with multiple ring binders, particularly where the rings are placed close together making the embodiment wherein a multiplicity of leaves placed between the binder rings, as described below, impractical.

FIG. 3 is a top view of the page lifter in the form of a single sheet of highly flexible material 19, or two leaves of material joined together by tape or other highly flexible means 17 and 18 at the locus of the rod 4, located between the binder rings 14 and 15 passing under rod 4. The page lifter in FIG. 3 is held in place by conventional means; for example, by tape or other adhesive means, by mechanical means such as placing rivets in the page lifter on each side of the center line lying under the rod 4, or merely by the friction between the rod 4 and the ring base cover 5.

The page lifter as shown in FIG. 3 located between the binder rings can be one of a multiplicity of page lifters located between many or all of the binder rings in a multiple ring looseleaf binder.

FIG. 4 is an end view of the binder partially closed with the page lifter, of a FIG. 1 embodiment type, lifting the pages to the top of the binder ring 15.

FIG. 5 is a top view of the page lifter in the form of stiff wire loops located outside of the rings of a two ring binder. The stiff wire loop page lifters 20 and 21 are affixed to the ring base cover 5 by hinged means which, in this example, consists of holes and indentations in the ring base cover into which the end of the stiff wire loop, bent at a 90° angle, fits, as at 22.

The page lifters of all types shown or described will perform in a simple manner. By attaching the inner part of the page lifter to the ring base cover 5, as shown, sufficient leverage is imparted to the pages in the proper direction to lift them to the top of the binder ring on closing the binder, without manual assistance, preventing the pages from being caught at the bottom of the rings and thus preventing the pages from being torn at the ring holes.

This invention is intended to include other possible embodiments of page lifting devices which comprise rigid or flexible leaves which are attached to the ring base cover by hinged or flexible means within the following claims and is not limited to the particular embodiments of the description and figures.

What is claimed is:

1. A page lifting device for use with a looseleaf binder having front and back covers, binding rings and a ring base cover which comprises at least one pair of stiff wire loops rotatably mounted on the top of the ring base cover by a hinge means at or contiguous with the centerline of said ring base cover, said loops being mounted perpendicular to and surrounding at least one of the binding rings and being of sufficient height to freely pass over the binding rings; whereby on closing the looseleaf binder the outermost parts of said loops encounter the inside surfaces of the looseleaf binder's front and back covers, forcing said loops toward the center of said binder and thus forcing the sides of said loops to encounter the bottom edges of any pages contained in said binder, thereby forcing said pages to rise on the binding rings away from the ring base cover toward the uppermost part of said binding rings preventing the pages from being caught between the binding and the inside surfaces of the looseleaf binder's front and back covers, wherein the hinge means by which the stiff wire loops are attached to the top of the ring base cover comprises the ring base cover having two indentations formed in the surface thereof for each of the stiff wire loops, at least one end face of each of the indentations having a hole formed therein, and each of the stiff wire loops having its ends angled to lie parallel to the ring base cover; the indentations in said ring base cover and the holes in the faces thereof being located and being of sufficient size to allow the angled ends of the stiff wire loops to be placed therethrough, rotatably attaching the stiff wire loops to the ring base cover.

2. A page lifting device for use with a looseleaf binder having front and back covers, binding rings and a ring base cover, which comprises at least one pair of leaves of rigid material, each leaf having a tubular channel formed in the inner edge thereof; a rod of a diameter which will allow it to pass through the tubular channel and of a length greater than that of the leaves' tubular channels' overall length; and attachment means by which each end of the rod means is fixed to the top of the ring base cover; the inner edges of said leaves of rigid material being formed in an interlocking pattern whereby the rod means passes through each pair of leaves to form a hinge and the attachment means fixes the hinge so formed to the top of the ring base cover at the center line thereof.

3. A page lifting device as recited in claim 2 wherein each pair of said leaves is located between two adjacent binding rings.

4. A page lifting device as recited in claim 2 wherein said leaves have slotted holes located therein to surround one or more binding rings of sufficient size to pass over the binding rings on closing the looseleaf binder.

* * * * *